US010947828B2

(12) United States Patent
Roy et al.

(10) Patent No.: US 10,947,828 B2
(45) **Date of Patent: *Mar. 16, 2021**

(54) DOWNHOLE SURVEILLANCE

(71) Applicant: OPTASENSE HOLDINGS LIMITED, Farnborough (GB)

(72) Inventors: James Roy, Calgary (CA); Carson Laing, Calgary (CA)

(73) Assignee: OPTASENSE HOLDINGS LIMITED, Hampshire (GB)

( * ) Notice: Subject to any disclaimer, the term of this patent is extended or adjusted under 35 U.S.C. 154(b) by 338 days.

This patent is subject to a terminal disclaimer.

(21) Appl. No.: 15/121,455

(22) PCT Filed: Mar. 31, 2015

(86) PCT No.: PCT/GB2015/050984

§ 371 (c)(1),
(2) Date: Aug. 25, 2016

(87) PCT Pub. No.: WO2015/150781

PCT Pub. Date: Oct. 8, 2015

(65) Prior Publication Data

US 2016/0369607 A1 Dec. 22, 2016

(30) Foreign Application Priority Data

Mar. 31, 2014 (GB) ..... 1405746.7

(51) Int. Cl.
*E21B 43/24* (2006.01)
*E21B 43/30* (2006.01)
(Continued)

(52) U.S. Cl.
CPC ..... *E21B 43/2406* (2013.01); *E21B 34/06* (2013.01); *E21B 43/305* (2013.01); *E21B 47/135* (2020.05); *E21B 47/14* (2013.01)

(58) Field of Classification Search
CPC ..... E21B 34/06; E21B 43/305; E21B 47/123; E21B 47/14; E21B 43/2406; E21B 47/135
See application file for complete search history.

(56) References Cited

U.S. PATENT DOCUMENTS 9,347,312 B2 * 5/2016 Vincelette ..... E21B 43/2406
2005/0001623 A1 * 1/2005 Hanstein ..... G01V 3/28 324/336

(Continued)

FOREIGN PATENT DOCUMENTS

EP 2386881 B1 * 5/2014 ..... G01V 1/52
GB 2 442 745 4/2008

(Continued)

*Primary Examiner* — Crystal J Miller
(74) *Attorney, Agent, or Firm* — McDonnell Boehnen Hulbert & Berghoff LLP

(57) ABSTRACT

Method and apparatus for surveying the downhole environment in a steam stimulated well such as a Steam Assisted Gravity Draining well are described. One method comprises interrogating an optic fibre (104) arranged along the path of a well shaft (202, 204) within a steam stimulated well with optical radiation. At least one downhole steam pulse is generated and data gathered from the fibre (104) in response to the steam pulse is gathered and processed to provide an indication of the acoustic signals detected by at least one longitudinal sensing portion of the fibre (104). In some examples, the processed data can be used to determine at least one characteristic of the steam chamber (210).

21 Claims, 3 Drawing Sheets

(51) Int. Cl.

| | |
|---|---|
| ***E21B 47/14*** | (2006.01) |
| ***E21B 47/135*** | (2012.01) |
| ***E21B 34/06*** | (2006.01) |

(56) References Cited

U.S. PATENT DOCUMENTS

| | | | | |
|---|---|---|---|---|
| 2011/0229071 | A1* | 9/2011 | Vincelette | E21B 43/2406 385/13 |
| 2011/0280103 | A1* | 11/2011 | Bostick, III | G01V 1/16 367/35 |
| 2012/0092960 | A1* | 4/2012 | Gaston | E21B 47/101 367/35 |
| 2014/0036628 | A1* | 2/2014 | Hill | G01V 1/42 367/35 |
| 2016/0245071 | A1* | 8/2016 | Vincelette | E21B 43/2406 |
| 2016/0251957 | A1* | 9/2016 | McEwen-King | E21B 43/2406 73/152.39 |

FOREIGN PATENT DOCUMENTS

| | | |
|---|---|---|
| WO | WO 2010 123566 | 10/2010 |
| WO | WO 2012 082488 | 6/2012 |
| WO | WO 2012 123760 | 9/2012 |
| WO | WO 2012 137021 | 10/2012 |
| WO | WO 2012 137022 | 10/2012 |
| WO | WO 2013 032687 | 3/2013 |

* cited by examiner

DOWNHOLE SURVEILLANCE

FIELD OF THE INVENTION

The present invention relates to methods and apparatus for downhole surveillance of wells, and in particular but not exclusively, to downhole surveillance in wells employing steam stimulated recovery techniques.

BACKGROUND OF THE INVENTION

In order to extract oil efficiently from certain oil fields, in particular those which contain viscous oil or bitumen deposits, steam is sometimes used, usually with the primary purpose of increasing the temperature of the deposit (thereby lowering its viscosity), in large part by transferring heat as the steam condenses. Generally, steam is introduced though an 'injection' well shaft, and the heated deposit is removed via a 'production' well shaft.

As will be familiar to the skilled person, there are various steam stimulation techniques. For example, in Steam Assisted Gravity Draining (SAGD), when a reservoir containing a viscous resource deposit has been identified and geology allows, two bores are drilled, both with horizontal sections in the reservoir, an upper shaft running above a lower shaft. To allow thick, tar-like resources to flow, steam is injected through the upper shaft (and also, in some wells, initially through the lower shaft) causing the resource to heat up, liquefy and drain down into the area of the lower 'production' shaft, from which it is removed.

Other related techniques are 'steam flooding' (also known as 'continuous steam injection'), in which steam is introduced into the reservoir though (usually) several injection well shafts, lowering the viscosity, and also, as the steam condenses to water, driving the oil towards a production well shaft. In a variant of this, so-called cyclic steam injection, the same shaft may function both as an injection well shaft and as a production well shaft. First, steam is introduced (this stage can continue for a number of weeks), then the well is shut in, or sealed, allowing the steam to condense and transfer its heat to the deposit. Next, the well is re-opened and oil is extracted until production slows down as the oil cools. The process may then be repeated.

Conventionally, injection well shaft casings have included a long slot from which the steam is released in order to achieve even heating of the reservoir. However, as the steam tends to follow the path of least resistance, heating can be localised. This meant that the so-called 'steam cavern' or 'steam chamber' formed could be irregular in shape, leading to inefficient production and the risk of 'steam breakthough' whereby steam finds its way to the production well, mixing with the oil as it is extracted.

More recently, and to address such limitations, injection well casings have been designed with number of discrete vents with slide valves rather than single long slots. Examples are described in WO2012/082488 and WO2013/032687 in the name of Halliburton, which also produces a commercial product known as the sSteam™ Valve. In a known SAGD application, pressure and temperature sensors have been used to estimate the shape of a steam cavern, and multiple sSteam™ valves within an injection well have been selectively controlled to improve the shape by selective injection of steam along the length of an injection well shaft.

In general, and as the skilled person is aware, gathering information about the physical environment within and surrounding a well is useful both in terms of understanding what level of reserves are present and ensuring that the reserves are recovered in an efficient, effective and economic manner. Therefore, geophysical surveying, including seismic surveying, is usually carried out at various times throughout well development and use. While traditionally such surveying was carried out using geophones or hydrophones, fibre optic sensors are becoming a well-established technology for a range of applications. This includes the use of downhole fibres, which can be placed while the well is being constructed and remain in place throughout the lifecycle of the well, and are interrogated with optical radiation when information is required. The fibres may contain sensor portions (for example, Fibre Bragg Gratings (FBGs)) can be used to form interferometers used to monitor strain in the fibre portion between the two FBGs) or may operate as 'distributed sensors', particularly Distributed Acoustic Sensor (DAS) fibres, in which the intrinsic scattering sites within the fibre return a signal.

In DAS sensing, a single length of (typically single mode) fibre which can be unmodified, in the sense of being free of any mirrors, reflectors, gratings, or (absent any external stimulus) any change of optical properties along its length can be used. One example of a DAS fibre is described in GB2442745, the content of which is hereby incorporated by reference. Such a sensor may be seen as a fully distributed or intrinsic sensor as it uses the intrinsic scattering processes inherent in an optical fibre and thus distributes the sensing function throughout the whole of the optical fibre. Further examples are provided by WO2012/137021 and WO2012137022. The content of these three applications is incorporated herein to the fullest extent possible.

WO2012/123760 is an application which describes the use of fibre optics in seismic surveying, and is incorporated herein to the fullest extent possible.

There remains a need to accurately and conveniently provide downhole surveying, particularly in relation to steam stimulated wells.

SUMMARY OF THE INVENTION

According to one aspect of the present invention there is provided a method of downhole surveillance in a steam stimulated well comprising: providing a downhole sensor within a steam stimulated well; providing at least one downhole steam pulse, sampling data gathered from said sensor in response to the steam pulse; and processing said data to provide an indication of the acoustic signals detected the sensor in response to the steam pulse. The sensor may comprise a fibre optic sensor and processing said data may comprise processing said data to provide an indication of the acoustic signals detected by at least one longitudinal sensing portion of said fibre in response to the steam pulse.

It will be appreciated that the steam pulse provides a pressure wave and therefore acts as an acoustic signal source.

The method may comprise changing the location of steam pulses (i.e. providing a first pulse from a first location and at least a second pulse at a second location, which is spaced apart from the first location). In one example, the source of steam pulses may be moved along the length of at least a portion of the well shaft. This will allow different 'views' of the downwell environment to be captured.

A steam pulse may be generated by shutting off steam injection into the well, then allowing a pulse of steam to enter the well. In other examples, a pulse may comprise a relatively high pressure pulse within the steam flow. Such methods are particularly convenient as no additional apparatus is required to provide the steam pulse. In such examples, the well preferably comprises an injection shaft, and the method may comprise controlling the steam flow therefrom. For example, the injection shaft may comprise one or more valves, and the method may comprise controlling the valves. Where more than one valve is provided, the method may comprise controlling each valve individually, or as part of a subset. The valves may be throttle valves, capable of controlling the flow rate, or may comprise binary (on/off) valves. Controlling the valves individually or as part of a subset also allows the source of the steam pulse to move along the shaft. Different combinations of valves could also be used at one time to effectively shape a shot of steam to provide a steam pulse. It may also be desirable to provide a series of pulses, for example at predetermined, possibly varying, intervals, lengths and/or pressures. Such pulses can therefore provide a form of 'continuous wave' and/or 'frequency chirp' in the steam pulses, which may facilitate processing and analysis of the data returned. For example, such a pattern may make it easier to distinguish the signal of interest from signals resulting from acoustic signal sources other than the steam pulse(s).

In some examples, it may be desirable to carry out an initial calibration step, for example by providing a sample pulse from one or more positions. The response to such pulse(s) could be measured and used to determine which sensing portions are affected by a steam pulse from a given position.

As the skilled person will be aware, well steam stimulation techniques, which include Steam Assisted Gravity Draining, Cyclic Steam Stimulation, Steam Driving, Steam Flooding, etc. often have more than one well shaft. Such steam stimulated wells usually have an injection well shaft through which steam is introduced to the well, which may be separate from, or also capable of functioning as, a production well shaft. In an example, the acoustic pulse is provided from, or from the vicinity of, a first well shaft, and the fibre will be arranged along the length of a second well shaft.

In some examples, the method further comprises using the processed data to determine a characteristic of the downhole environment. As used herein, the term 'downhole environment' should be taken to include the form (size, shape, density, solid to fluid characteristics) etc) of a steam chamber, where formed, as well as the form of the reservoir and geological formations surrounding and inside the reservoir. Such formations may comprise shale plugs or mud plugs, which may comprise obstructions within a steam chamber and, by consideration of reflection seismics, caprock integrity and the like.

The determined characteristic may relate to any characteristic of the form of a steam chamber. This is advantageous is that it allows the downhole environment to be better understood. The output may be numerical or visual. The method may (but need not) create a 3D representation of the steam chamber.

In particular examples, the method may also comprise controlling the injection of steam such that a steam chamber tends towards desired parameters. For example, if a steam chamber is better developed in one region than another, steam flow to the underdeveloped region could be increased so that the steam chamber tends towards a regular shape, which may improve production. In a further example, if the reservoir is draining quicker from one area than another, it may be desired to develop the steam chamber in the underproducing area.

The method may comprise a method of distributed acoustic sensing (DAS), and the step of gathering data may comprise gathering Rayleigh backscattered optical radiation from the fibre. The method may further comprise launching a series of optical pulses into said fibre and detecting radiation backscattered by the fibre; and processing the detected Rayleigh backscattered radiation to provide a plurality of discrete longitudinal sensing portions of the fibre. Such methods may further comprise the step of adjusting interrogation parameters to vary the portions of fibre from which data is sampled. In other words, the method may involve sampling from a first set of longitudinal sensing portions at a first time and then sampling from a second set of different longitudinal sensing portions at a second time. A section of fibre corresponding to one of the longitudinal sensing portions of the first set may comprise portions of two longitudinal portions of fibre of the second set. The size of the longitudinal sensing portions of fibre in the first set and the second set may be different.

In another aspect, the present invention relates to a computer program product which, when run on a suitably programmed computer connected to or embodied within a controller for an optical interrogator or a downhole fibre optic and a controller of a steam pulse source, performs the method described above.

In another aspect the present invention provides a method of steam injection in a steam stimulated well comprising performing steam injection to establish a steam chamber; providing one or more acoustic shocks in the steam chamber; receiving acoustic data feedback from a downhole fibre optic sensor regarding the steam chamber; and controlling subsequent steam injection based on said acoustic data feedback. The step of controlling may comprise controlling the rate of steam injection and/or independent control of one or more valves in an injection shaft. The step of providing one or more acoustic shocks may comprise providing an acoustic shock from within the steam chamber, for example by stopping steam injection, then providing a pulse of steam as the acoustic source or providing a pressure pulse within the steam flow.

The invention also relates to apparatus for downhole surveillance in a steam stimulated well, said apparatus comprising: an optic fibre adapted, in use, to lie along the path of a well shaft within a steam stimulated well, a fibre optic interrogator adapted to provide acoustic sensing on the fibre; an acoustic source arranged, in use, to generate a downhole steam pulse in the steam chamber, wherein the interrogator is further arranged to process acoustic signals detected by said fibre in response to the steam pulse. The or each acoustic source may be arranged to generate the acoustic pulse within a steam chamber.

In general the invention may relate to the use of acoustic sensing to provide feedback in relation to the acoustic signals generated by an acoustic pulse (which may be a downhole acoustic pulse) in a steam stimulated well. Preferably, the pulse is a downhole pulse, which may be generated by steam. The feedback may be provided to an operator of the well, and/or may be processed (and in some examples, a response provided) automatically.

The invention extends to methods, apparatus and/or use substantially as herein described with reference to the accompanying drawings.

Any feature in one aspect of the invention may be applied to other aspects of the invention, in any appropriate combination. In particular, method aspects may be applied to apparatus aspects, and vice versa.

Furthermore, features implemented in hardware may generally be implemented in software, and vice versa. Any reference to software and hardware features herein should be construed accordingly.

DESCRIPTION OF THE DRAWINGS

The invention will now be described by way of example only with respect to the accompanying drawings, of which.

DESCRIPTION OF THE INVENTION

Figure 1:
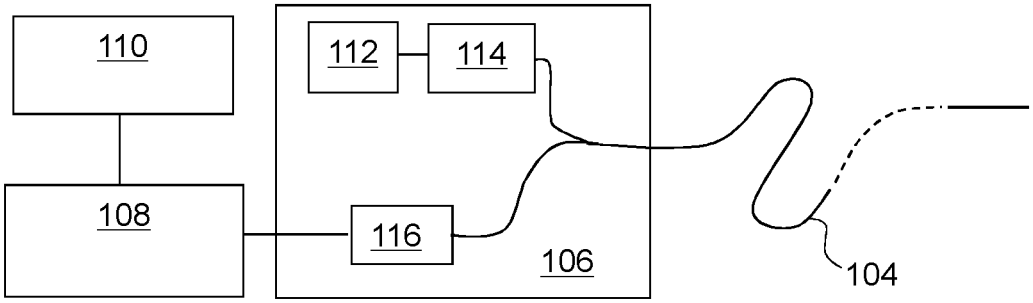
FIG. 1 illustrates components of a distributed acoustic sensor used in embodiments of the present invention.

FIG. 1 shows a schematic of a distributed fibre optic sensing arrangement. A length of sensing fibre 104 is removably connected at one end to an interrogator 106. The output from the interrogator 106 is passed to a signal processor 108, which may be co-located with the interrogator or may be remote therefrom, and optionally a user interface/graphical display 110, which in practice may be realised by an appropriately specified PC. The user interface 110 may be co-located with the signal processor 108 or may be remote therefrom.

The sensing fibre 104 can be many kilometres in length, for example at least as long as the depth of a wellbore which may typically be around 1.5 km long. In this example, the sensing fibre is a standard, unmodified single mode optic fibre such as is routinely used in telecommunications applications without the need for deliberately introduced reflection sites such a fibre Bragg grating or the like. The ability to use an unmodified length of standard optical fibre to provide sensing means that low cost, readily available fibre may be used. However in some embodiments the fibre may comprise a fibre which has been fabricated to be especially sensitive to incident vibrations, or indeed may comprise one or more point sensors or the like. In addition, the fibre may be coated with a coating to better suit use in high temperature wells. In use the fibre 104 is deployed to lie along the length of a wellbore, such as in a production or injection well shaft as will be described in relation to FIG. 2 below.

As the skilled person is aware, Distributed acoustic sensing (DAS) offers an alternative form of fibre optic sensing to point sensors. In DAS, a single length of longitudinal fibre is optically interrogated, usually by one or more input pulses, to provide substantially continuous sensing of vibrational activity along its length. Optical pulses are launched into the fibre and the radiation backscattered from within the fibre is detected and analysed. By analysing the radiation Rayleigh backscattered within the fibre, the fibre can effectively be divided into a plurality of discrete sensing portions which may be (but do not have to be) contiguous. Within each discrete sensing portion, mechanical vibrations of the fibre, for instance from acoustic sources, cause a variation in the amount of radiation which is backscattered from that portion. This variation can be detected and analysed and used to give a measure of the intensity of disturbance of the fibre at that sensing portion.

Accordingly, as used in this specification the term "distributed acoustic sensor" will be taken to mean a sensor comprising an optic fibre which is interrogated optically to provide a plurality of discrete acoustic sensing portions distributed longitudinally along the fibre and acoustic shall be taken to mean any type of mechanical vibration or pressure wave, including seismic waves. Note that as used herein the term optical is not restricted to the visible spectrum and optical radiation includes infrared radiation and ultraviolet radiation.

Since the fibre has no discontinuities, the length and arrangement of fibre sections corresponding to a measurement channel is determined by the interrogation of the fibre. These can be selected according to the physical arrangement of the fibre and the well it is monitoring, and also according to the type of monitoring required. In this way, the distance along the fibre, or depth in the case of a substantially vertical well, and the length of each fibre section, or channel resolution, can easily be varied with adjustments to the interrogator changing the input pulse width and input pulse duty cycle, without any changes to the fibre. Distributed acoustic sensing can operate with a longitudinal fibre of 40 km or more in length, for example resolving sensed data into 10 m lengths. In a typical downhole application, a fibre length of a few kilometres is usual, i.e. a fibre runs along the length of the entire borehole and the channel resolution of the longitudinal sensing portions of fibre may be of the order or 1 m or a few metres. The spatial resolution, i.e. the length of the individual sensing portions of fibre, and the distribution of the channels may be varied during use, for example in response to the detected signals.

In operation, the interrogator 106 launches interrogating electromagnetic radiation, which may for example comprise a series of optical pulses having a selected frequency pattern, into the sensing fibre 104. The optical pulses may have a frequency pattern as described in GB patent publication GB2,442,745 the contents of which are hereby incorporated by reference thereto. As described in GB2,442,745, the phenomenon of Rayleigh backscattering results in some fraction of the light input into the fibre being reflected back to the interrogator, where it is detected to provide an output signal which is representative of acoustic disturbances in the vicinity of the fibre. The interrogator 106 therefore conveniently comprises at least one laser 112 and at least one optical modulator 114 for producing a plurality of optical pulse separated by a known optical frequency difference. The interrogator also comprises at least one photodetector 116 arranged to detect radiation which is Rayleigh backscattered from the intrinsic scattering sites within the fibre 104.

The signal from the photodetector is processed by a signal processor 108. The signal processor conveniently demodulates the returned signal based on the frequency difference between the optical pulses, for example as described in GB2,442,745. The signal processor may also apply a phase unwrap algorithm as described in GB2,442,745. The phase of the backscattered light from various sections of the optical fibre can therefore be monitored. Any changes in the effective path length from a given section of fibre, such as would be due to incident pressure waves causing strain on the fibre, can therefore be detected. Further examples of pulses and processing techniques are provided by WO2012/137021 and WO2012/137022.

The form of the optical input and the method of detection allow a single continuous fibre to be spatially resolved into discrete longitudinal sensing portions. That is, the acoustic signal sensed at one sensing portion can be provided substantially independently of the sensed signal at an adjacent portion. Such a sensor may be seen as a fully distributed or intrinsic sensor, as it uses the intrinsic scattering processed inherent in an optical fibre and thus distributes the sensing function throughout the whole of the optical fibre.

To ensure effective capture of the signal, the sampling speed of the photodetector 116 and initial signal processing is set at an appropriate rate. In most DAS systems, to avoid the cost associated with high speed components, the sample rate would be set around the minimum required rate.

As mentioned above, the fibre 104 is interrogated to provide a series of longitudinal sensing portions or 'channels', the length of which depends upon the properties of the interrogator 106 and generally upon the interrogating radiation used. The spatial length of the sensing portions can therefore be varied in use, even after the fibre has been installed in the wellbore, by varying the properties of the interrogating radiation. This is not possible with a convention geophone array, where the physical separation of the geophones defines the spatial resolution of the system. The DAS sensor can offer a spatial length of sensing portions of the order of 10 m.

Figure 2:
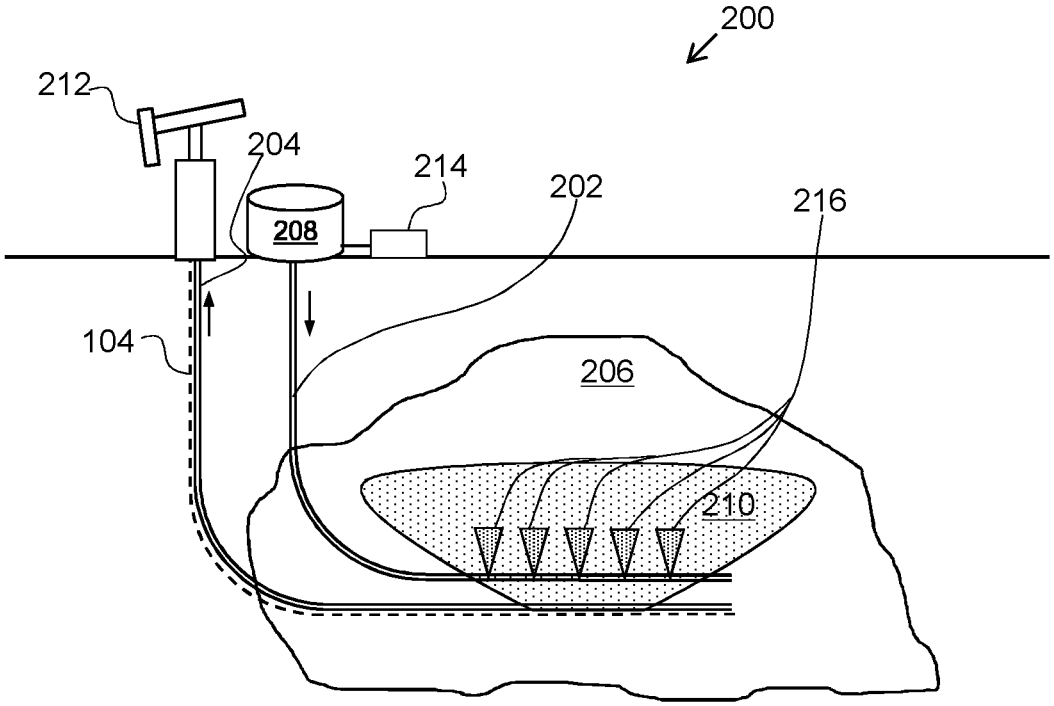
FIG. 2 is an example of a deployment of a fibre optic distributed acoustic sensor in a Steam Assisted Gravity Draining well.

As the sensing optical fibre 104 is relatively inexpensive, it may be deployed in a wellbore location in a permanent fashion as the costs of leaving the fibre 104 situ are not significant. The fibre 104 is therefore conveniently deployed in a manner which does not interfere with the normal operation of the well. In some embodiments a suitable fibre may be installed during the stage of well constructions, such as shown in FIG. 2, which shows a Steam Assisted Gravity Drainage (SAGD) well 200.

As will be familiar to the skilled person, a SAGD well 200 is formed by drilling two bore holes to serve as an 'injection' shaft 202 and a 'production' shaft 204. Both bore holes have substantially horizontal portions, with the injection shaft 202 being arranged a few meters above the production shaft 204 but substantially parallel thereto. Both horizontal shaft portions run through an underground resource reservoir 206, which in the case of a SAGD well 200 is typically a viscous oil or bitumen reservoir (the term 'oil' as used herein should be understood as including all such resources).

In use of the SAGD well 200, a steam generator 208 is used to generate steam which is released into the reservoir 206 from the horizontal portion of the injection shaft 202. This steam heats the resource within the reservoir 206, decreasing its viscosity. Over time, the steam forms a steam chamber 210, which allows the heated resource to flow to the horizontal portion of the production shaft 204, which collects the resource, which is in turn pumped to the surface by pumping apparatus 212. The apparatus further comprises a controller 214 in association with the injection shaft 202. This controller 214 is arranged to control valves (further described in relation to FIG. 3 below) within the injection shaft 202 to selectively release steam therefrom. In this particular example, five individual valves producing five distinct plumes of steam 216 into the chamber 210 are illustrated. However, it will be appreciated that a real system could be several kilometres in length and there may be fewer, more, or indeed many more valves provided.

As will be familiar to the skilled person, while the arrangement above is fairly typical, variations are known, such as using the production shaft 204 to introduce steam at least in the initial stages of heating. Other similar schemes which use steam to heat a reservoir are also known, including Cyclic Steam Stimulation, in which one shaft is used alternately as a production shaft and an injection shaft, and steam flooding, in which oil is both heated by steam released form one or more injection shafts, and urged towards a production well. Any such methods could benefit from the use of the general principles described herein, and constitute methods of steam stimulation which may be employed in steam stimulated wells.

Such shafts 202, 204 are usually formed by drilling a bore hole and then forcing sections of metallic casing down the bore hole. The various sections of the casing are joined together as they are inserted to provide a continuous outer casing. After the production casing has been inserted to the depth required, the void between the borehole and the casing is backfilled with cement, at least to a certain depth, to prevent any flow other than through the well itself. In this example, the production shaft 204 is fitted with an optical fibre to be used as the sensing fibre 104. In this example, the fibre 104 is clamped to the exterior of the outer casing as it is being inserted into the borehole. In this way the fibre 104 may be deployed along the entire length of the wellbore and subsequently cemented in place for at least part of the wellbore. It has been found that an optical fibre which is constrained, for instance in this instance by passing through the cement back fill, exhibits a different acoustic response to certain events to a fibre which is unconstrained. An optical fibre which is constrained may give a better response than one which is unconstrained and thus it may be beneficial to ensure that the fibre in constrained by the cement.

Of course, other deployments of optical fibre may be possible however, for instance the optical fibre could be deployed within the outer casing but on the exterior of some inner casing or tubing. Fibre optic cable is relatively robust and once secured in place can survive for many years in the downwell environment.

The fibre 104 protrudes from the well head and is connected to the interrogator 106, which may operate as described above.

The interrogator 106 may be permanently connected to the fibre 104, although it may also be removably connected to the fibre 104 when needed to perform a survey but then can be disconnected and removed when the survey is complete. The fibre 104 though remains in situ and thus is ready for any subsequent survey. The fibre 104 is relatively cheap and thus the cost of a permanently installed fibre is not great. Having a permanently installed fibre in place does however remove the need for any sensor deployment costs in subsequent surveys and removes the need for any well intervention. This also ensures that in any subsequent survey the sensing fibre 104 is located in exactly the same place as for the previous survey. This readily allows for the acquisition and analysis of data at different times to provide a time varying analysis.

Figure 3A:
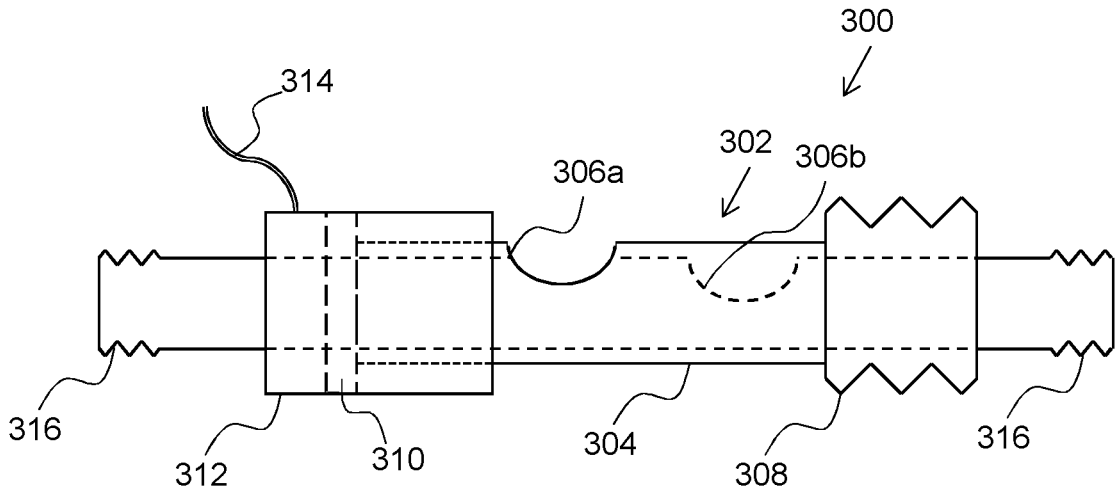
FIGS. 3A and 3B illustrate a section of a well shaft casing comprising a valve, shown in a closed and open position respectively.
Figure 3B:
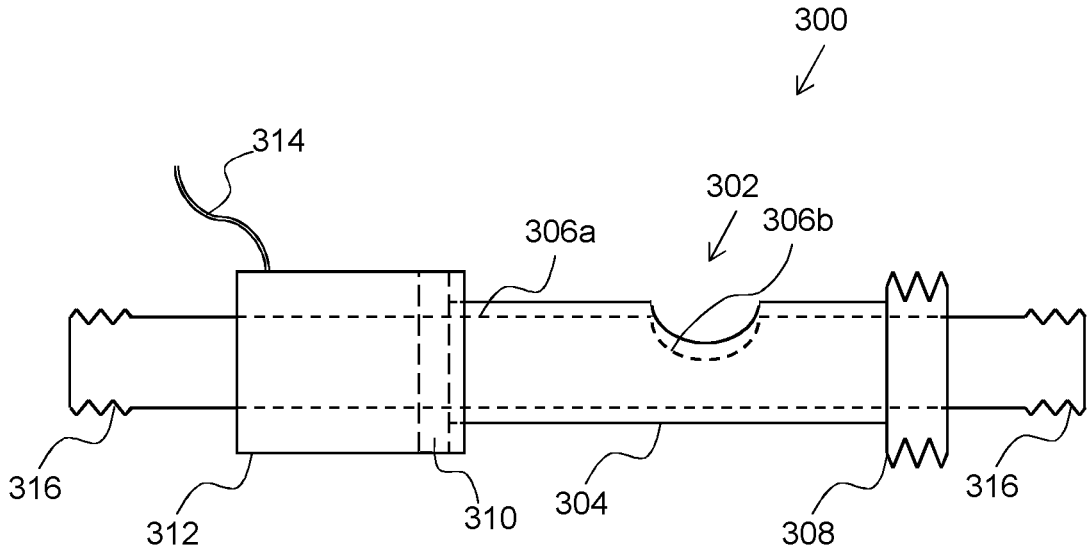

As now described in conjunction with FIGS. 3A and 3B, in this example the injection shaft 202 production casing is formed at least in part of a number of sections 300, each comprising a separately controllable valve 302. The valve 302, which is shown in the closed position (in which steam flow into the reservoir 206 is prevented) in FIG. 3A and the open position in FIG. 3B, comprises a cylindrical slider portion 304, which fits about the circumference of the casing section 300, and is able to slide along its length. Both the slider portion 304 and the casing section 300 comprise vent holes 306*a*, 306*b*, which may be aligned, opening the valve (as in FIG. 3B) or offset, closing the valve (as in FIG. 3A). The valve 302 further comprises a resilient member 308, which generally urges the slider portion 304 towards an annular piston 310 which is housed in an annular pneumatic chamber 312. Fluid may be introduced to the chamber 312 through a conduit 314 (for example controlled from the surface), forcing the piston 310 and in turn the slider portion 304 against the action of the resilient member 308, and thus placing the vent holes 306*a*, 306*b* into alignment.

As will be appreciated by the skilled person, in practice, such a valve 302 would also incorporate various gaskets, O-rings and the like to ensure that fluid is contained or released only as desired. However, these have been omitted for reasons of simplicity.

The section 300 further comprises fixings 316 at each end thereof, allowing it to be joined to other sections, which may also be valve sections 300, or may be other designs, such as valveless sections (which could be simple tubular sections), or sections incorporating other monitoring equipment or the like.

In other examples, there may be further, or alternative valves provided. For example, such valves could block the injection shaft 202 entirely, releasing steam only once one or more given vent point was open.

Figure 4:
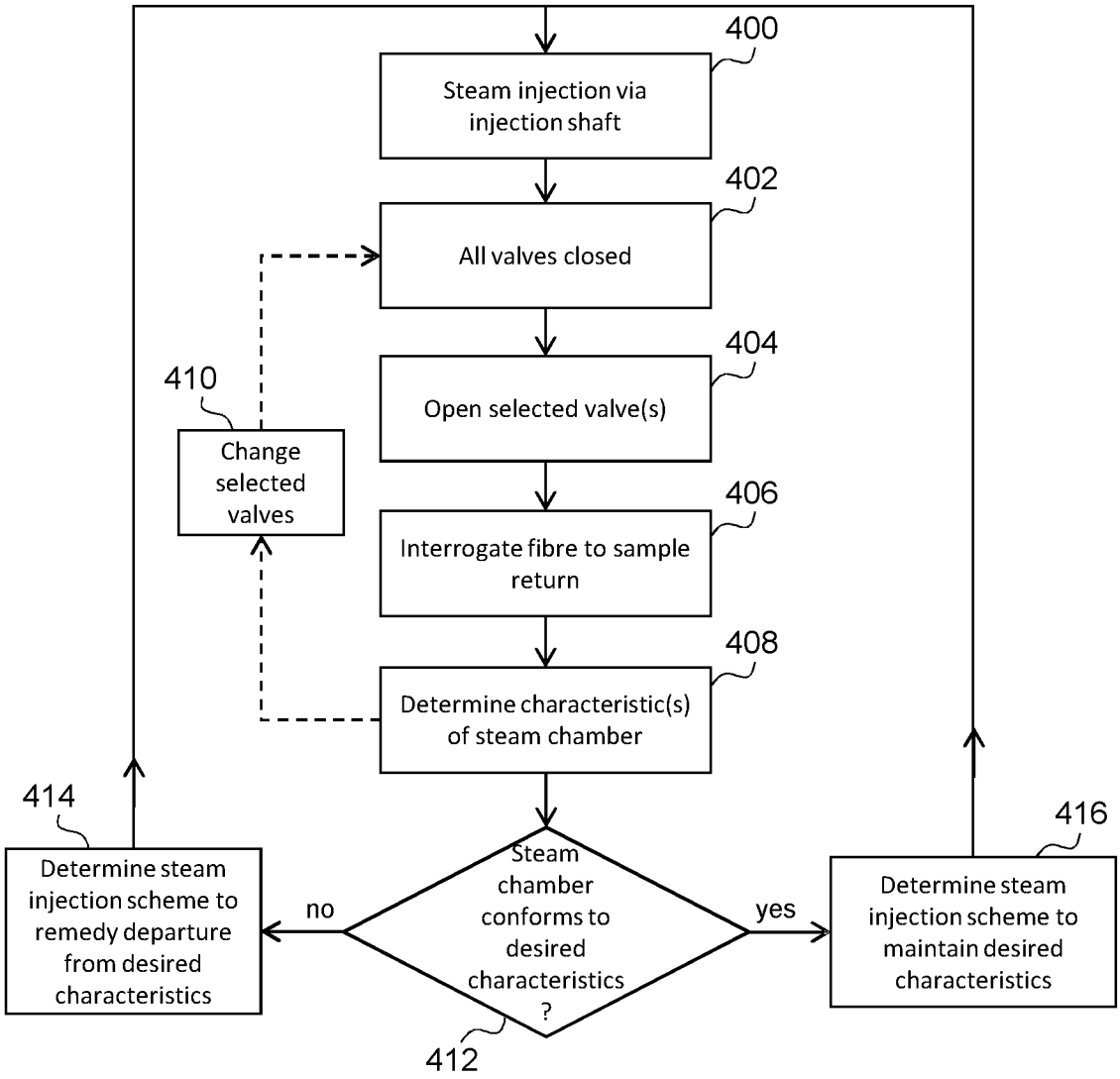
FIG. 4 is a flow chart showing a method of use of the apparatus according to one embodiment of the present invention.

FIG. 4 is a flow chart showing steps in the operation of the apparatus. In this example, it is assumed that a steam chamber 210 has formed and the apparatus described above is being used to determine the form of the chamber 210.

As the method starts therefore, in step 400, a steam injection process is being carried out. In step 402, the injection shaft 202 is operated with all valves 302 closed. As will be appreciated, the steam chamber 210, once formed, will remain open for some time even after steam injection is stopped. Steam production is continued until the pressure inside the injection shaft 202 reaches a predetermined value.

In step 404, a selected one or more of the valves 302 is opened rapidly, causing a pressure pulse of steam (which is at the predetermined- and preferably relatively high-pressure) to be released into the chamber 210 under the control of the controller 214. The controller 214 in conjunction with each valve 302 or combination of valves 302 therefore effectively act as an acoustic source, providing an acoustic shock to the chamber 210.

In step 406, the sensing fibre 104 is then interrogated to determine the response resulting from the steam pulse.

The signals from a given steam pulse, i.e. a given acoustic stimulus, can be detected from each of the longitudinal sensing portions of the optical fibre 104 (assuming the signals have not been completely attenuated). Thus it is possible to receive a signal from each sensing portion of fibre 104 along the entire length of the production shaft 204 (or at least the horizontal portion thereof). The result will be a series of signals indicating the seismic signals detected over time in each longitudinal section of the fibre 104. The sensing fibre 104 thus effectively acts as a series of point seismometers but one which can cover the entire length of the wellbore at the same time, unlike a conventional geophone array. Further as the optical fibre 104 can be installed so as to not interfere with normal well operation no well intervention is required.

In this way, a 'snap shot' of the condition (which may include one or more of an indication of the shape, density, solid to fluid characteristics, viscosity of fluids or the like) of the steam chamber 210 and/or further information about the downhole environment can be obtained. In particular, it may be possible to determine the extent and level of the reservoir 206, an indication of the shape of the reservoir 206, as well as the presence, location and extent of both of geological formations therein (including the presence of shale plugs and/or mud plugs), and of the geological formations in which the reservoir 206 lies (for example, by consideration of reflection seismics, caprock integrity and the like).

There may be a strong acoustic reflection from the boundary between the steam chamber 210 and the fluid in the reservoir 206 or any geological formation within the reservoir 206. This boundary may be readily determined by a pronounced change in the intensity of the returned acoustic signal. The time taken for the signal to reach the boundary and be returned to the sensing fibre allows the position of the boundary (and therefore the shape of the chamber 210) to be estimated.

In other examples, phase changes and amplitude changes may also be considered in the signal.

Of course, there may be other sources of acoustic noise, which may complicate the signal, but signal processing could reduce such noise. For example, an acoustic background obtained just before and/or after the pulse is introduced, and this could be subtracted from the signal if this proves to be relatively stable, or the pulse could be repeated several times on the assumption that the shape of the chamber 210 will not change significantly between pulses, and commonalities between such subsequently acquired sample sets could be considered and used to derive an estimate of the shape of the chamber 210. Such a process is similar to 'seismic stacking', and will result in improved signal to noise ratio. Indeed, pulses could form a sequence, with a given (possibly varying) interval pattern (e.g. analogous to a frequency chirp) or at varying pressures, which may allow the response to the steam pulses to be more readily separated from a background noise.

In the present embodiment, all equipment remains in situ, so gathering repeated readings is relatively simple. Indeed, this also means that, while pulses may be provided in a relatively short space of time to provide data about the status of a steam chamber, they may also be provided periodically, to monitor the evolution of the steam chamber, in a form of time-lapse survey.

It may also be the case that there are known rock formations or the like within the reservoir 206, which may mask the true extent of the chamber 210. Therefore, the acoustic data could be combined with other sources of data (such as obtained for seismic surveying of the reservoir 208, or use of seismic interferometry, etc) to assist in building a full picture of the downhole environment.

Thus, in step 408, data relating to at least one characteristic of the steam chamber 210 (preferably including an estimate of the position of at least part of the outer boundary of chamber 210) is derived. It will be noted that the data gathered may be used to directly determine aspects of the shape and structure of the chamber 210, rather than inferring them from other variables, such as the temperature or injectability of the steam.

Moreover, in the example described herein, different valves 302 within the injection shaft 202 can be opened under the control of the valve controller 214, effectively providing a number of different views of the downhole environment and reservoir 206. Therefore, in the example of FIG. 4, step 410 may be included, which comprises selecting a new valve 302 or combination of valves 302 as part of a loop, in which steps 404-408 are repeated using a number of different selected valves 302 to further develop the understanding and accuracy of the determined characteristic(s).

This is analogous to changing the view point of the snap shot, and may help resolve ambiguities in the data. For example, the chamber 210 may initially be estimated to have an irregular shape but taking data from another angle (i.e. following a pulse from a different valve 302), it may be revealed that a rock formation within the reservoir was actually placing a portion of a well-formed steam chamber 'in shadow' with respect to the first valve 302, as the pressure pulse from the second valve 302 may be at an angle to pass behind the obstruction. Of course, it also allows multiple readings, which may be combined to improve signal to nose ratio.

Such selection of the valves 302 could be under the control of an operator, who may seek to specifically resolve ambiguities within the data. However, it could also be done automatically, either intelligently in response to an ambiguity identified by the processor 208, or in a pre-programmed manner, for example, following a predetermined scheme such as opening each valve in order along the length of the shaft 202, or in some other combination/sequence. Of course, any combination of these techniques could also be used.

Once this process is complete (this may for example be a predetermined level of confidence in the data is reached, or after pulses have been emitted from a given number of valves or a given valve positions, or in some other way), a comparison is made with at least one predetermined desired characteristic of the chamber 210 (step 412). For example, the chamber 210 may be desired to have a generally cone-like shape, tapering towards a narrower bottom end in the regions of the production shaft 204 as shown in FIG. 2. Departures from this desired shape may be identified and, in step 414, the valves 302 of the injection shaft 202 may be controlled to remedy this, for example by increasing steam flow (and therefore heat input) to an area of the steam chamber which is lower than it should be, thus locally growing the steam chamber 210. Alternatively, it may be revealed that the steam chamber has not developed beyond a geological formation, and additional heat could be applied to this area.

Of course, if the steam chamber 210 is found to conform to desired characteristic(s) in step 412, steam injection may recommence to maintain the characteristic(s), for example as previously, or in another distribution intended to maintain the shape of the steam chamber 210. For example, if remedial action has been successful, the steam injection may revert to injection steam from all, or from an even distribution of, valves 302 (step 416).

Some or all of the steps could be carried out automatically, with the processor 108 providing an input to control the valve controller 214, but in most embodiments, it is likely that at least some of the steps will be carried out under the control of an operator of the well 200.

Various alternatives to the above embodiment will be apparent to the skilled person and are within the scope of this invention. For example, although a SAGD well has been described, the system could be employed in other steam stimulated wells. The fibre could be provided on the same shaft as the acoustic source. Although steam has been described as only the acoustic source (which is convenient as it requires no additional apparatus to be installed and, in conjunction with more than one controllable valve, allows the source of an acoustic pulse to move along the shaft), there could be other acoustic sources, such as providing one or more dedicated impluser or the like. Although the above embodiments act to remedy the shape of a steam chamber, the method may also provide advance indication of steam breakthrough, or another disadvantageous state, and result in partially or fully shutting down the well, or simply to provide geological information. Whilst certain schemes for distributed acoustic sensing have been described above, other schemes could be employed, or indeed other fibre optic, or non fibre-optic, sensing techniques, such as providing discreet sensors or sensor portions of fibre, could be employed.

The invention has been described with respect to various embodiments. Unless expressly stated otherwise the various features described may be combined together and features from one embodiment may be employed in other embodiments.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

The invention claimed is:

1. A method of downhole surveillance in a steam stimulated well comprising:

interrogating an optic fibre arranged along a path of a well shaft within the steam stimulated well with optical radiation, wherein interrogating the optic fibre comprises:

launching a series of optical pulses into said optic fibre;

detecting Rayleigh radiation backscattered by the optic fibre; and processing the detected Rayleigh backscattered radiation to provide a plurality of discrete longitudinal sensing portions of the optic fibre;

providing at least one downhole steam pulse as an acoustic signal source;

sampling data gathered from said optic fibre in response to the steam pulse; and processing said data to provide an indication of acoustic signals detected by at least one of the discrete longitudinal sensing portions of said optic fibre.

2. The method according to claim 1, further comprising generating the steam pulse within a steam chamber.

3. The method according to claim 1, further comprising generating a series of steam pulses with varying duration, pressures, or time intervals therebetween.

4. The method according to claim 3, wherein the well comprises an injection shaft, and wherein the method further comprises controlling the steam flow therefrom to generate a steam pressure pulse.

5. The method according to claim 4, wherein the injection shaft comprises one or more valves, and wherein the method further comprises controlling the one or more valves.

6. The method according to claim 5, further comprising controlling each of the valves independently or in groups.

7. The method according to claim 1, further comprising using the processed data to determine at least one characteristic of the downhole environment.

8. The method according to claim 7, wherein the at least one determined characteristic is a shape of a steam chamber, and wherein the method further comprises comparing the shape to a desired shape.

9. The method according to claim 8, further comprising controlling an injection of steam such that the shape of the steam chamber approaches the desired shape.

10. The method according to claim 1, further comprising generating at least one steam pulse at at least two spaced locations.

11. The method according to claim 1, wherein the well comprises more than one well bore, and wherein the method further comprises:

generating the steam pulse from, or from a vicinity of, a first well bore; and providing the optic fibre along at least a portion of a length of a second well shaft.

12. The method according to claim 1, wherein processing said data to provide the indication of acoustic signals detected by at least one of the discrete longitudinal sensing portions of said optic fibre comprises considering phase changes and amplitude changes in the data.

13. An apparatus for downhole surveillance in a steam stimulated well, said apparatus comprising:

an optic fibre adapted, in use, to lie along a path of a well shaft within the steam stimulated well;

a fibre optic interrogator adapted to provide acoustic sensing on the optic fibre by interrogating the optic fibre, wherein interrogating the optic fibre comprises:

launching a series of optical pulses into said optic fibre;

detecting Rayleigh radiation backscattered by the optic fibre; and processing the detected Rayleigh backscattered radiation to provide a plurality of discrete longitudinal sensing portions of the optic fibre;

an acoustic source arranged, in use, to generate a downhole steam pulse in a steam chamber; and a processor adapted to provide an indication of acoustic signals detected by at least one of the discrete longitudinal sensing portions of said optic fibre, wherein the fibre optic interrogator is further arranged to sample acoustic signals detected by said optic fibre in response to the steam pulse.

14. The apparatus according to claim 13, wherein the fibre optic interrogator and the processor are co-located.

15. The apparatus according to claim 14, wherein a plurality of acoustic sources are provided.

16. The apparatus according to claim 13, wherein at least one acoustic source comprises one or more valves in a steam injection well shaft.

17. The apparatus according to claim 16, wherein a plurality of valves are provided, and wherein the acoustic source further comprises a controller capable of controlling the valves independently or in groups.

18. The apparatus according to claim 17, wherein the processor is capable of determining at least one characteristic of the downhole environment.

19. The apparatus according to claim 18, wherein at least one determined indication is a shape of a steam chamber, wherein the shape of the steam chamber is compared to a desired shape, and wherein the controller is further arranged to control the valves so as to control the steam flow therefrom such that the shape of the steam chamber approaches the desired shape.

20. A method of steam injection in a steam stimulated well comprising:

performing steam injection to establish a steam chamber;

providing one or more acoustic shocks to the steam chamber, wherein at least one of the one or more acoustic shocks comprises a steam pressure pulse;

receiving acoustic data feedback from a downhole fibre optic sensor regarding the downhole environment, wherein receiving acoustic data feedback from the downhole fibre optic sensor comprises:

launching a series of optical pulses into an optic fibre arranged along a path of a well shaft within the steam stimulated well;

detecting Rayleigh radiation backscattered by the optic fibre; and processing the detected Rayleigh backscattered radiation to provide a plurality of discrete longitudinal sensing portions of the optic fibre; and controlling subsequent steam injection based on said acoustic data feedback.

21. The method according to claim 20, wherein controlling subsequent steam injection comprises controlling a rate of steam injection or independent control of one or more valves in an injection shaft.

* * * * *